US007213554B2

(12) United States Patent
Kanada et al.

(10) Patent No.: US 7,213,554 B2
(45) Date of Patent: May 8, 2007

(54) VALVE TIMING CONTROL APPARATUS FOR INTERNAL COMBUSTION ENGINE

(75) Inventors: Yoji Kanada, Gamagori (JP); Osamu Komazawa, Chita (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 26 days.

(21) Appl. No.: 11/290,442

(22) Filed: Dec. 1, 2005

(65) Prior Publication Data

US 2006/0124093 A1 Jun. 15, 2006

(30) Foreign Application Priority Data

Dec. 14, 2004 (JP) ..... 2004-361973

(51) Int. Cl.
*F01L 1/34* (2006.01)

(52) U.S. Cl. ..... 123/90.17; 123/90.15; 123/90.12; 123/90.16; 464/1; 464/2; 464/160; 92/120

(58) Field of Classification Search ..... 123/90.17
See application file for complete search history.

(56) References Cited

U.S. PATENT DOCUMENTS 6,035,819 A 3/2000 Nakayoshi et al.
6,053,139 A 4/2000 Eguchi et al.
6,058,897 A * 5/2000 Nakayoshi ..... 123/90.17
6,684,835 B2 * 2/2004 Komazawa et al. ..... 123/90.17
6,886,515 B2 * 5/2005 Ogawa ..... 123/179.18
2002/0043231 A1 4/2002 Hase
2003/0121486 A1 7/2003 Komazawa et al.

FOREIGN PATENT DOCUMENTS

EP 0 896 129 A1 8/1998
JP 2002-97912 9/2000
JP 2003-172110 12/2001

OTHER PUBLICATIONS

European Search Report dated Apr. 18, 2006.

* cited by examiner

*Primary Examiner*—Thomas Denion
*Assistant Examiner*—Kyle M. Riddle
(74) *Attorney, Agent, or Firm*—Reed Smith LLP; Stanley P. Fisher, Esq.; Juan Carlos A. Marquez, Esq.

(57) ABSTRACT

A valve timing control apparatus for controlling an opening and closing timing of a valve of an internal combustion engine includes a driving side rotational member synchronously rotated with a crankshaft, a driven side rotational member provided coaxially with the driving side rotational member and synchronously rotated with a camshaft, a fluid pressure chamber being separated into an advanced angle chamber and a retarded angle chamber, a phase control apparatus for displacing a relative rotational phase between the driving side rotational member and the driven side rotational member, a locking mechanism having a movable member, a judging device for judging a supply condition of the operation fluid relative to the fluid pressure chamber, and a control device for controlling a rotational speed of the crankshaft.

6 Claims, 9 Drawing Sheets

VALVE TIMING CONTROL APPARATUS FOR INTERNAL COMBUSTION ENGINE

This application is based on and claims priority under 35 U.S.C. § 119 to Japanese Patent Application 2004-361973, filed on Dec. 14, 2004, the entire content of which is incorporated herein by reference.

FIELD OF THE INVENTION

This invention relates to a valve timing control apparatus for controlling an opening and closing timing of valves of an internal combustion engine for a vehicle engine, or the like.

BACKGROUND

A valve timing control apparatus is known which appropriately adjusts an opening and closing timing of a valve, and achieves optimal driving conditions by means of a displacement of a relative rotational phase between a driving side rotational member, which rotates in synchronization with a crankshaft, and a driven side rotational member, which rotates in synchronization with a camshaft. A known valve timing control apparatus is disclosed in JP2002-097912A (see pp.2–3 FIGS. 2–5).

The disclosed valve timing control apparatus includes a housing, a rotor, and a vane. The housing rotates in synchronization with the crankshaft, the rotor is relatively rotatably engaged with the housing to form a fluid pressure chamber between the housing and the rotor, and synchronously rotatable with the camshaft, and the vane is provided at the housing or the rotor to separate the fluid pressure chamber into a retarded angle chamber and an advanced angle chamber. The valve timing control apparatus further includes a first passage for operating a relative rotational phase between the housing and the rotor within a range from a most retarded angle phase to a most advanced angle phase, a locking member for locking the relative rotational phase at an intermediate phase within a range from the most retarded angle phase to the most advanced angle phase, a spring for operating the locking member in a locking direction, and a relative rotation controlling mechanism including a locking fluid passage for operating the locking member in an unlocking direction against a biasing force of the spring.

According to this valve timing control apparatus, when rotational speed of the engine is increased, because of a centrifugal force applied to the locking member, the locking member is unlocked against a biasing force of the spring. In view of the above mentioned considerations, in order to make the locking member less likely to be unlocked caused by the centrifugal force due to a rotation of the engine, when the relative rotational phase between the housing and the rotor is locked at a predetermined intermediate phase, the valve timing control apparatus supplies fluid into one of the retarded angle chamber and the advanced angle chamber, and drains the fluid from the other of the retarded angle chamber and the advanced angle chamber, and hence the locking member generates a frictional resistance force (i.e., a resistance in the unlocking direction). Accordingly, with the configuration of the valve timing control apparatus disclosed in JP2002-097912A, because a fluid pressure of the one of the retarded angle chamber and the advanced angle chamber is applied to the vane, a biasing force in one direction is applied to the vane. In consequence, in a condition where the relative rotational phase is locked, the locking member and a mating wall surface are relatively pressed and a friction therebetween is increased. Accordingly, the resistance force is increased and the locking member is thereby less likely to shift in a centrifugal direction.

According to the valve timing control apparatus disclosed in JP2002-097912A, in order to prevent the locking member from being unlocked, the fluid pressure is necessarily supplied into the one of the retarded angle chamber and the advanced angle chamber. However, because the fluid pressure is supplied by means of a pump, which is activated by a driving force of the engine, immediately after an engine starting, the fluid pressure from the pump cannot be reached the one of the retarded angle chamber and the advanced angle chamber, thus the valve timing control apparatus less likely to supply a sufficient fluid pressure to the one of the retarded angle chamber and the advanced angle chamber. Therefore, if a control is performed for rapidly increasing the rotational speed of the engine immediately after the engine starting, because the fluid pressure is not yet sufficiently supplied into the one of the retarded angle chamber and the advanced angle chamber, the centrifugal force is applied to the locking member before the friction force between the locking member and the mating wall surface is increased, and the locking member may thereby occasionally be unlocked without difficulty.

A need thus exists for a valve timing control apparatus, which, even in a condition where the sufficient fluid pressure is not yet supplied to the valve timing control apparatus immediately after the engine starting, prevents the locking mechanism from being in an unlock state because of the centrifugal force caused by an increase of the rotational speed of the engine.

SUMMARY OF THE INVENTION

According to an aspect of the present invention, a valve timing control apparatus for controlling an opening and closing timing of a valve of an internal combustion engine includes a driving side rotational member synchronously rotated with a crankshaft, a driven side rotational member provided coaxially with the driving side rotational member and synchronously rotated with a camshaft, a fluid pressure chamber formed on at least one of the driving side rotational member and the driven side rotational member, the fluid pressure chamber being separated into an advanced angle chamber and a retarded angle chamber, a phase control apparatus controlling supply and discharge of an operation fluid relative to one of, or both of the advanced angle chamber and the retarded angle chamber, for displacing a relative rotational phase between the driving side rotational member and the driven side rotational member, a locking mechanism having a movable member movable in a radial direction of the driving side rotational member and the driven side rotational member, the locking mechanism being at a lock state for restraining a displacement of the relative rotational phase when the movable member moves inwardly in the radial direction, and the locking mechanism being at an unlock state for allowing the displacement of the relative rotational phase when the movable member moves outwardly in the radial direction, a judging means for judging a supply condition of the operation fluid relative to the fluid pressure chamber, and a control means for controlling, after the internal combustion engine is started, a rotational speed of the crankshaft less than, or equal to a predetermined rotational speed, until the judging means judges that the operation fluid is supplied into the fluid pressure chamber.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Embodiments of the present invention will be explained hereinbelow with reference to the attached drawings.

Figure 1:
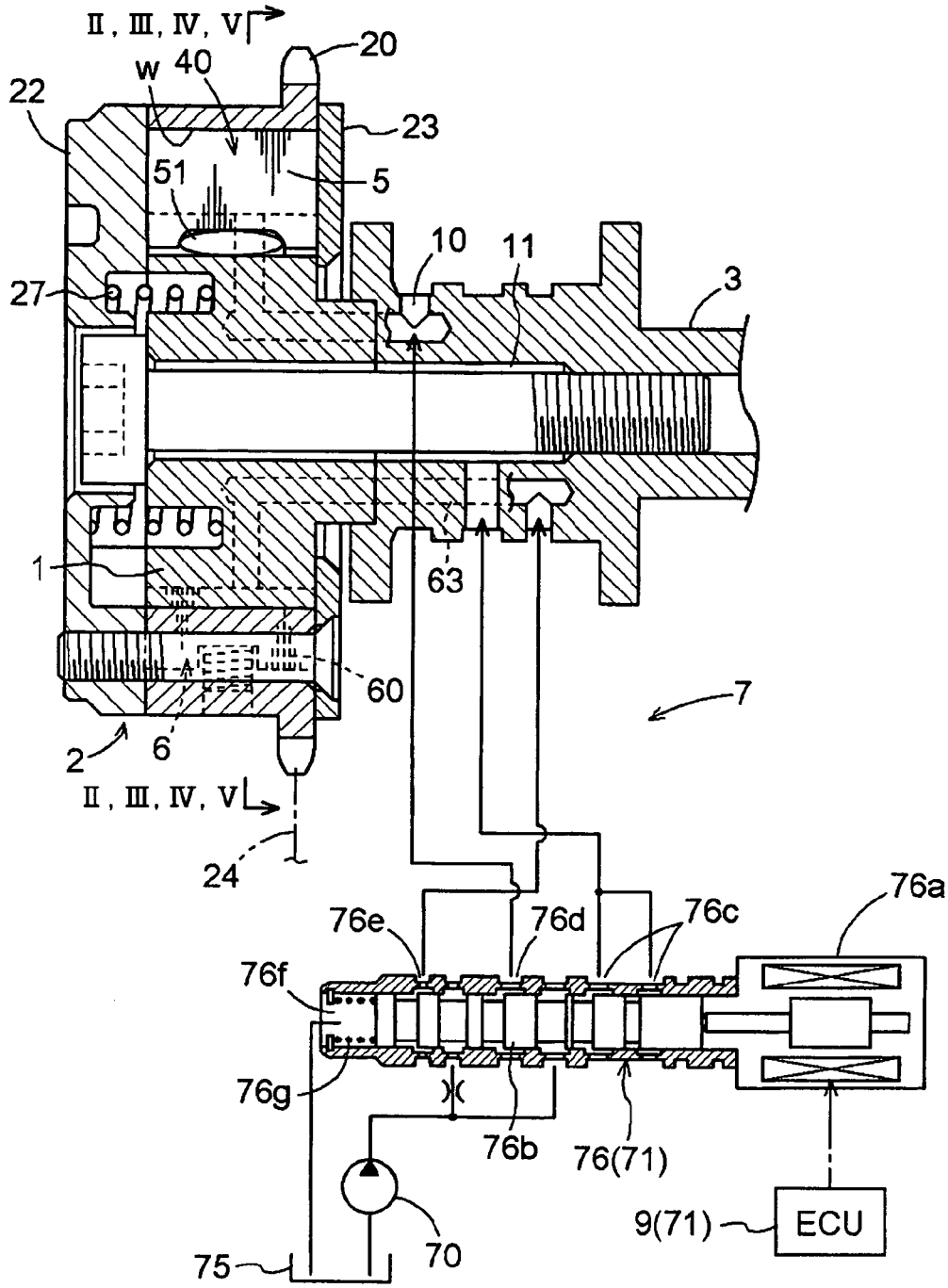
FIG. 1 is a sectional view of a valve timing control apparatus according to embodiments of the present invention.
Figure 2:
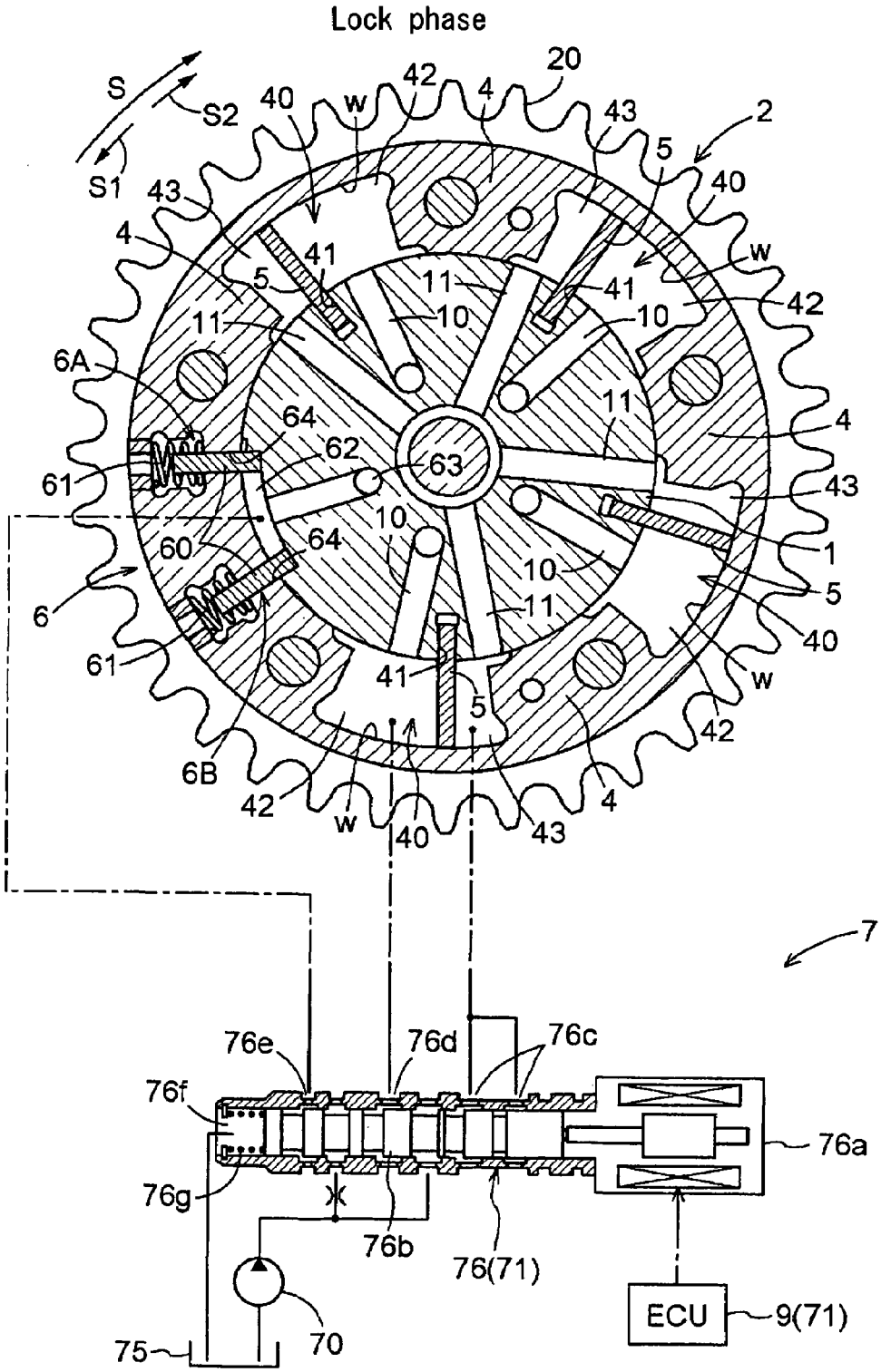
FIG. 2 is a sectional view of the valve timing control apparatus illustrating a condition where a relative rotational phase is at a lock phase and a locking mechanism is at a lock state, the sectional view which is taken along line II—II of FIG. 1.
Figure 3:
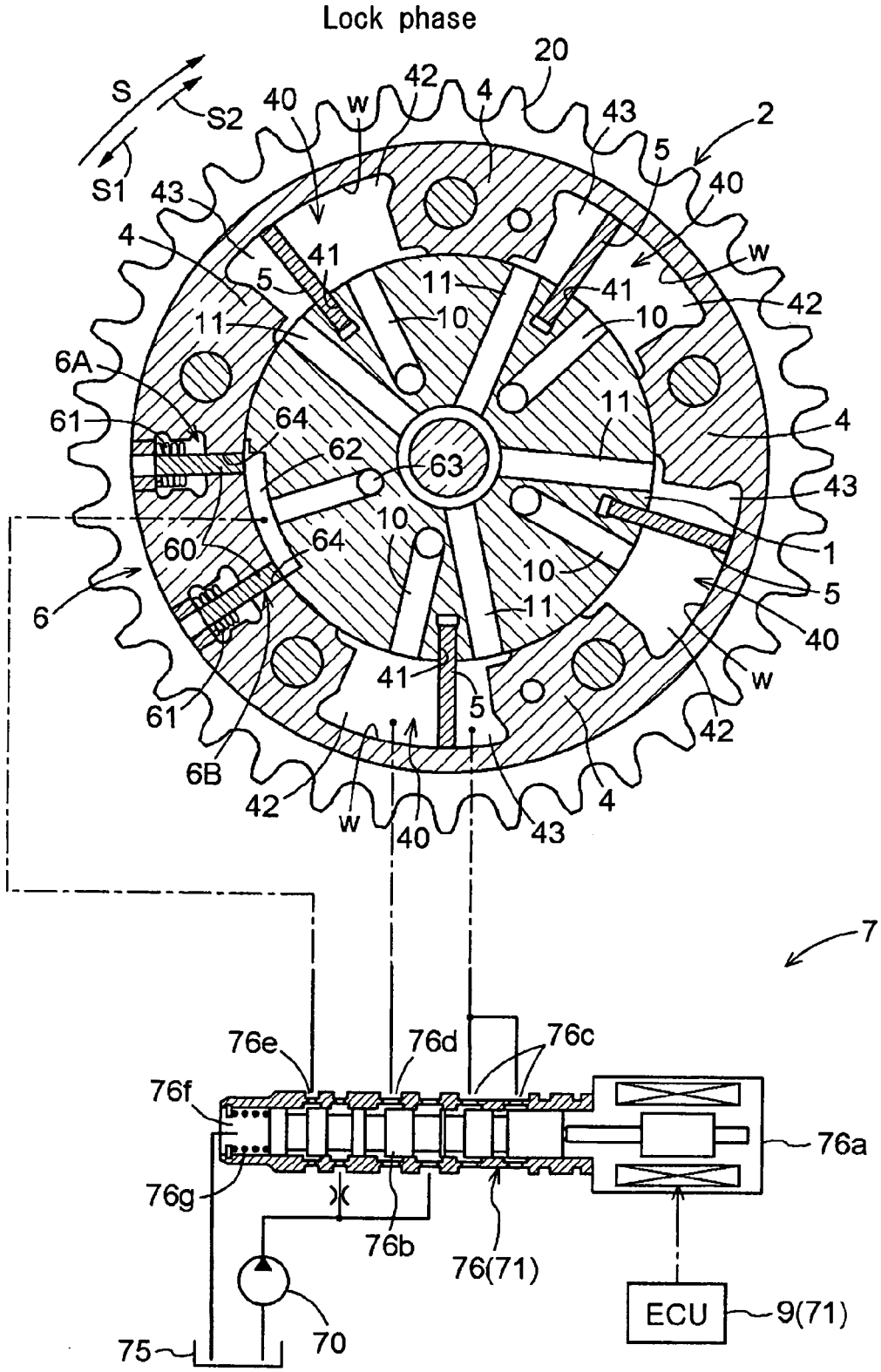
FIG. 3 is a sectional view of the valve timing control apparatus illustrating a condition where the relative rotational phase is at the lock phase and the locking mechanism is at an unlock state, the sectional view which is taken along line III—III of FIG. 1.

As illustrated in FIGS. 1–3, a valve timing control apparatus according to embodiments of the present invention includes an outer rotor 2 (i.e., a driving side rotational member), and an inner rotor 1 (i.e., a driven side rotational member). The outer rotor 2 rotates in synchronization with a crankshaft of an engine (not shown), and the inner rotor 1 is coaxially provided with the outer rotor 2 and rotates in synchronization with a camshaft 3.

The inner rotor 1 is integrally assembled at an end portion of the camshaft 3, which configures a rotational shaft of a cam for controlling an opening and closing timing of an intake valve and an exhaust valve of the engine. The camshaft 3 is rotatably assembled to a cylinder head of the engine.

Relative to the inner rotor 1, the outer rotor 2 is externally attached, and relatively rotatable within a predetermined relative rotational phase range. The outer rotor 2 is integrally provided with, at a side in which the camshaft 3 is connected, a rear plate 23, and is integrally provided with, at the other side, a front plate 22. Further, the outer rotor 2 is integrally provided with, at an outer circumference, a timing sprocket 20. A transmission member 24 such as a timing chain, a timing belt, or the like, is hung across the timing sprocket 20 and a sprocket assembled to the crankshaft of the engine.

When the crankshaft of the engine is rotated, a rotational force is transmitted to the timing sprocket 20 through the transmission member 24, then the outer rotor 2 rotates in a rotational direction S as illustrated in FIG. 2. Consequently, the inner rotor 1 rotates in the rotational direction S, then the camshaft 3 rotates, and then the cam provided at the camshaft 3 pushes down the intake valve or the exhaust valve of the engine to open the valve.

As illustrated in FIG. 2, the outer rotor 2 is arranged with plural protruding portions 4 along a rotational direction in such a manner to separate from each other. Each protruding portion 4 (i.e., a shoe) is protruded in a radial direction. Between each adjacent protruding portion 4 of the outer rotor 2, a fluid pressure chamber 40, defined by the outer rotor 2 and the inner rotor 1, is provided. According to the embodiments of the present invention, four fluid pressure chambers 40 are provided.

The inner rotor 1 is formed with, at a part of an outer circumferential portion facing the fluid pressure chamber 40, a vane groove 41. A vane 5, which separates the fluid pressure chamber 40 into an advanced angle chamber 43 and a retarded angle chamber 42 in a relative rotational direction (a direction of arrows S1 and S2 in FIG. 2), is slidably inserted into the vane groove 41 in a radial direction. As illustrated in FIG. 1, the vane 5 is biased toward an inner wall surface w of the fluid pressure chamber 40 by means of a spring 51 provided at a side of an inner diameter of the vane 5.

The advanced angle chamber 43 of the fluid pressure chamber 40 is communicated with an advanced angle passage 11 formed in the inner rotor 1, the retarded angle chamber 42 is communicated with a retarded angle passage 10 formed in the inner rotor 1, and the both of the advanced and retarded angle passages 11 and 10 are connected to a fluid pressure circuit 7. By supplying or discharging the operation fluid through the fluid pressure circuit 7 relative to one of, or both of the advanced angle chamber 43 and the retarded angle chamber 42, a biasing force is generated. The biasing force displaces a relative rotational phase between the inner rotor 1 and the outer rotor 2 within a range from a most advanced angle phase to a most retarded angle phase, or holds the relative rotational phase between the inner rotor 1 and the outer rotor 2 at a given phase.

As illustrated in FIG. 1, between the inner rotor 1 and the front plate 22 of the outer rotor 2, a torsion spring 27 serving as a biasing mechanism is provided that biases the relative rotational phase between the inner rotor 1 and the outer rotor 2 in the advanced angle direction. More particularly, the torsion spring 27 applies a torque, which normally biases the inner rotor 1 and the outer rotor 2, in a direction in which the vane 5 is displaced in the advanced angle direction (a direction of S2 in FIG. 2).

Further, between the inner rotor 1 and the outer rotor 2, the locking mechanism 6 is provided, which restrains the relative rotation of the inner rotor 1 and the outer rotor 2 in a condition where the relative rotational phase is at a predetermined lock phase (a phase illustrated in FIG. 2), which is set between the most advanced angle phase and the most retarded angle phase. The locking mechanism 6 includes a retarded angle locking portion 6A and an advanced angle locking portion 6B both of which are provided at the outer rotor 2. The locking mechanism 6 further includes a recess formed locking chamber 62 provided at a part of the outer circumference portion of the inner rotor 1. The locking chamber 62 communicates with a locking passage 63 formed in the inner rotor 1, and the locking passage 63 is connected to the fluid pressure circuit 7.

Each retarded angle locking portion 6A and the advanced angle locking portion 6B includes a locking member 60 and a spring 61. The locking member 60 is guided through a guide groove 64 provided at the outer rotor 2, and is slidable along the guide groove 64 in the radial direction of the outer rotor 2 and the inner rotor 1. The spring 61 biases the locking member 60 inwardly in the radial direction. According to various usages, the locking member 60 may adopt various shapes such as a plate shape, and a pin shape. According to the embodiments of the present invention, the locking member 60 represents a movable member. However, it is not limited to a structure that the movable member itself protrudes or retracts from one of the inner rotor 1 and the outer rotor 2 to the other of the inner rotor 1 and the outer rotor 2. Alternatively, or in addition, a component, which is movable in the radial direction in the inner rotor 1 or the outer rotor 2 in conjunction with the locking member 60, may be applied as the movable member. Moreover, it is not limited that the movable member moves in the radial direction, and a moving path of the movable member is not necessarily be the radial direction. It is applicable as long as the movable member is configured to move in the radial direction of the driving side rotational member and the driven side rotational member, as a result.

The retarded angle locking portion 6A prevents the inner rotor 1 from relatively rotating in the retarded angle direction relative to the outer rotor 2 by operating the locking member 60 inwardly in the radial direction and protruding into the locking chamber 62. In contrast, the advanced angle locking portion 6B prevents the inner rotor 1 from relatively rotating in the advanced angle direction relative to the outer rotor 2 by operating the locking member 60 inwardly in the radial direction and protruding into the locking chamber 62. More particularly, by protruding one of the retarded angle locking portion 6A and the advanced angle locking portion 6B into the locking chamber 62, a displacement of the relative rotational phase into one of the retarded angle direction and the advanced angle direction is restricted, and the displacement of the relative rotational phase into the other one of the retarded angle direction and the advanced angle direction is allowed. A protruding operation of the locking member 60 into the locking chamber 62 is performed, by means of a biasing force of the spring 61, in a drain condition where the operation fluid is not supplied into the locking chamber 62.

As illustrated in FIG. 2, in a condition where the locking member 60 of the retarded angle locking portion 6A and the locking member 60 of the advanced angle locking portion 6B are operated inwardly in the radial direction and protruded into the locking chamber 62, a lock state is achieved for restraining the displacement of the relative rotational phase between the inner rotor 1 and the outer rotor 2 at the predetermined lock phase, which is set between the most advanced angle phase and the most retarded angle phase. Regarding a valve opening and closing timing of the engine, the lock phase is set for obtaining a smooth startability of the engine, and the locking mechanism 6 is configured to achieve the lock state in which the relative rotational phase is restrained at the lock phase by means of cranking for the engine starting.

The locking member 60 is retracted from the locking chamber 62 by supplying the operation fluid into the locking chamber 62 through the locking passage 63. More particularly, when the locking chamber 62 is filled with the operation fluid, because of a pressure of the operation fluid in the locking chamber 62, a biasing force, which is applied in a direction in which the locking member 60 is housed in the outer rotor 2 (a direction in which the locking member 60 is retracted from the locking chamber 62) is generated. In a condition where the biasing force generated by the pressure of the operation fluid becomes greater degree than the biasing force of the spring 61, which is applied in a direction in which the locking member 60 is protruded into the locking chamber 62, the locking member 60 is operated outwardly in the radial direction and retracted from the locking chamber 62 as illustrated in FIG. 3. Accordingly, the locking mechanism 6 achieves an unlock state, which allows the displacement of the relative rotational phase between the inner rotor 1 and the outer rotor 2.

The fluid pressure circuit 7 includes an oil pump 70, a control valve 76, and an oil pan 75. The oil pump 70 supplies the operation fluid relative to the control valve 76 by means of a driving force of the engine, the control valve 76 controls supply and discharge of the operation fluid at plural ports by means of a control of the control unit 9 (i.e., an ECU: Electric Control Unit), and the oil pan 75 stores the operation fluid therein. According to the embodiments of the present invention, an electromagnetic spool valve is used as the control valve 76 that operates and displaces a spool 76*b* against a spring 76*g* by means of an energization from the control unit 9 to a solenoid 76*a*.

A first port 76*c* of the control valve 76 is connected to the advanced angle passage 11 communicating with the advanced angle chamber 43, a second port 76*d* of the control valve 76 is connected to the retarded angle passage 10 communicating with the retarded angle chamber 42, and a third port 76*e* of the control valve 76 is connected to the locking passage 63 communicating with the locking chamber 62. Further, a drain port 76*f* of the control valve 76 is communicated with the oil pan 75.

Figure 4:
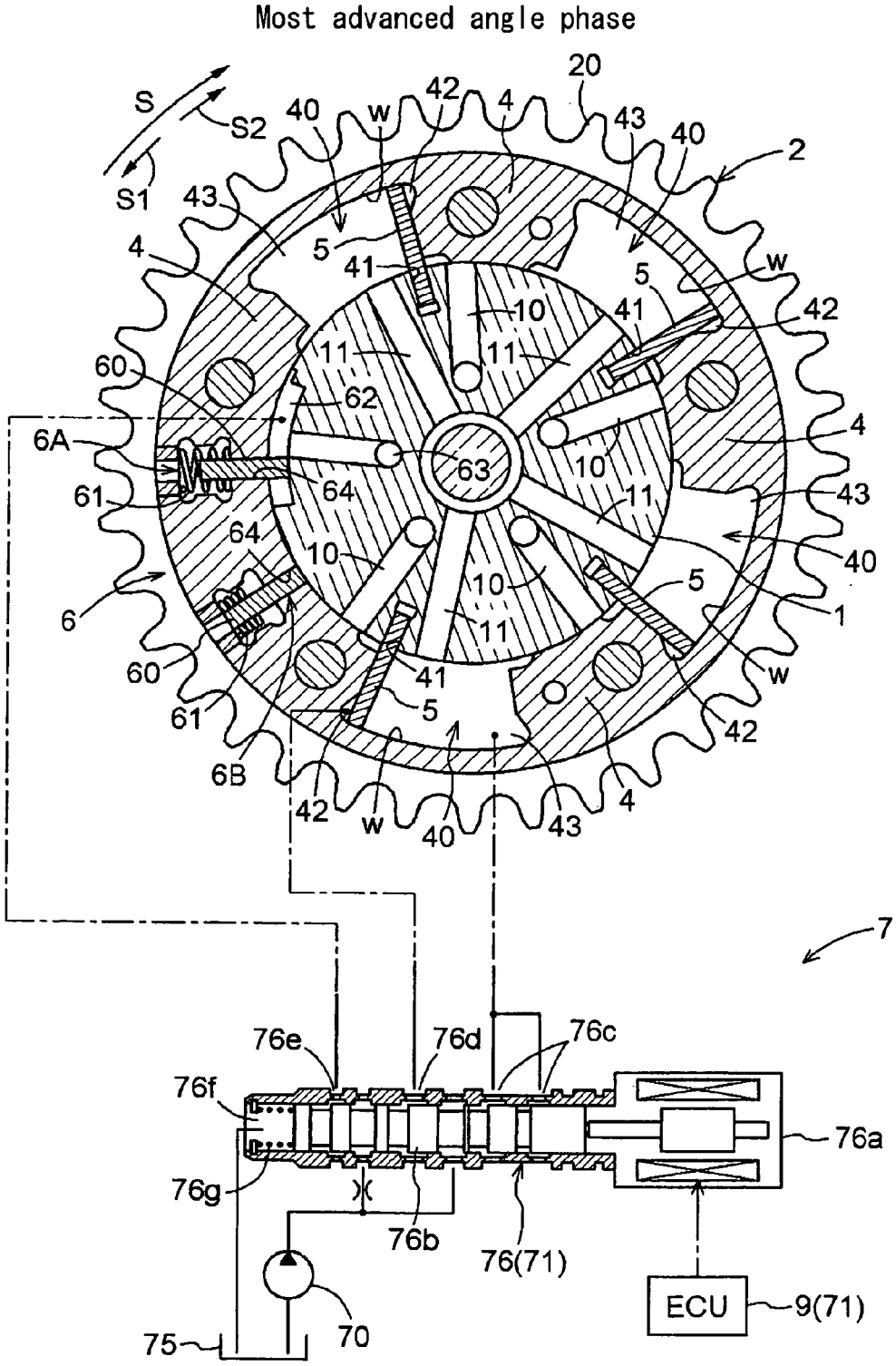
FIG. 4 is a sectional view of the valve timing control apparatus illustrating a condition where the relative rotational phase is at a most advanced angle phase, the sectional view which is taken along line IV—IV of FIG. 1.
Figure 5:
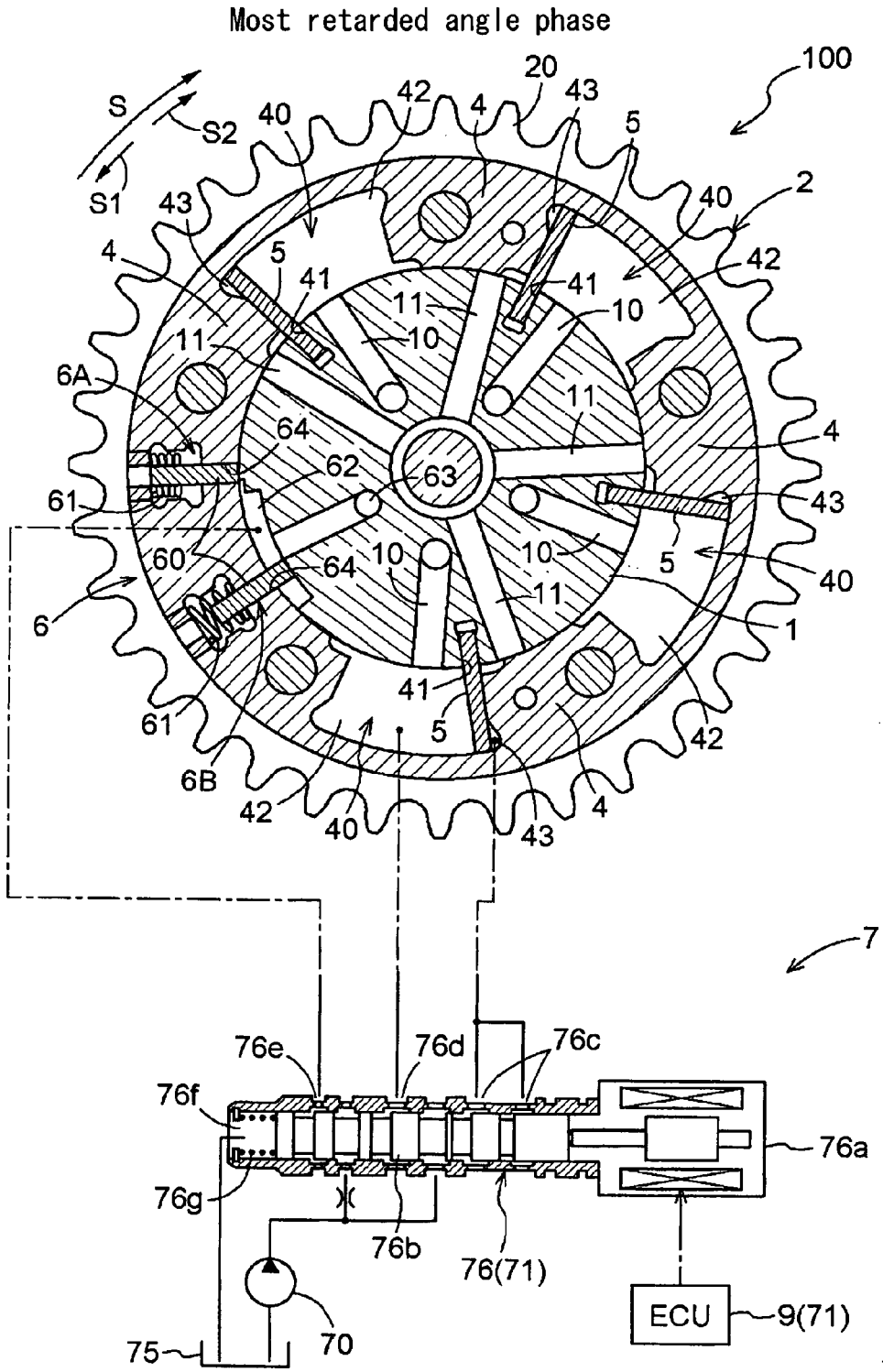
FIG. 5 is a sectional view of the valve timing control apparatus illustrating a condition where the relative rotational phase is at a most retarded angle phase, the sectional view which is taken along line V—V of FIG. 1.

By means of the control of the control unit 9, the control valve 76 controls, through the advanced angle passage 11 and the retarded angle passage 10, supply and discharge of the operation fluid relative to one of, or both of the advanced angle chamber 43 and the retarded angle chamber 42, and varies the relative position of the vane 5 in the fluid pressure chamber 40, and thereby controls the displacement of the relative rotational phase between the outer rotor 2 and the inner rotor 1 within the range from the most advanced angle phase (a phase in which a volume of the advanced angle chamber 43 is maximized) as illustrated in FIG. 4 to the most retarded angle phase (a phase in which a volume of the retarded angle chamber 42 is maximized) as illustrated in FIG. 5. Accordingly, the control valve 76 and the control unit 9 for controlling the control valve 76 both represent a phase control apparatus 71 according to the embodiments of the present invention.

According to the embodiments of the present invention, the control valve 76 also serves as a lock control apparatus, which controls an operation for varying a position of the locking mechanism 6 between the lock state and the unlock state. More particularly, by means of the control of the control unit 9, the control valve 76 controls supply and discharge of the operation fluid relative to the locking chamber 62 through the locking passage 63, and controls the protruding operation and a retracting operation of the locking member 60 relative to the locking chamber 62.

Figure 6:
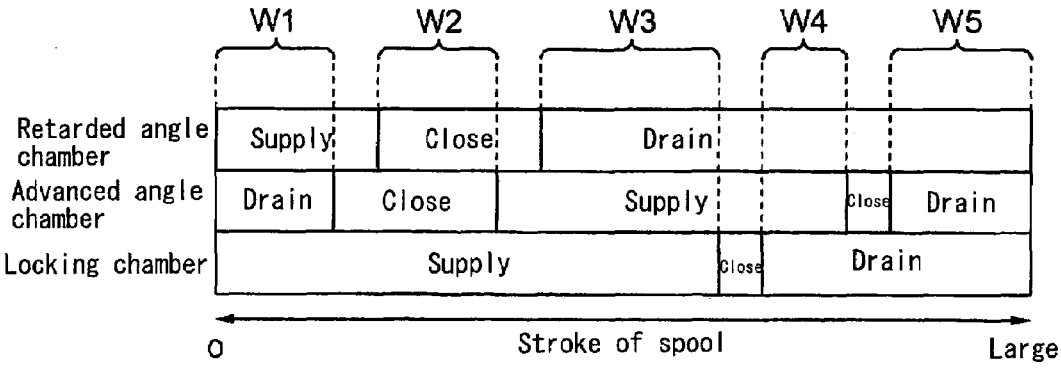
FIG. 6 is a view for explaining a relation between a stroke degree of a spool and operating conditions of a control valve according to the embodiments of the present invention.

As illustrated in FIG. 6, by controlling an amount of electricity supplied from the control unit 9 to the solenoid 76*a*, the control valve 76 of the fluid pressure circuit 7 controls a degree of a stroke of the spool 76*b*, and varies a spool position from position W1 to position W5, and thereby switches operations of supply, discharge (drain), and stop (close) of the operation fluid relative to the advanced angle chamber 43, the retarded angle chamber 42, and the locking chamber 62. According to the embodiments of the present invention, a control for the amount of electricity supplied to the solenoid 76*a* is performed by varying a duty value (%) of current for supplying to the solenoid 76*e*. The degree of the stroke of the spool 76*b* is proportional to the amount of electricity supplied to the solenoid 76*a* (the duty value of current). Control operations of the control valve 76 at each predetermined spool position is explained with reference to FIG. 6. However, the control operation is not limited as described below, and variations and changes may be made by others.

In a condition where the spool position is at the position W1, the control valve 76 supplies the operation fluid into the locking chamber 62, retracts the locking member 60 from the locking chamber 62, and makes the locking mechanism 6 into the unlock state. Further, by supplying the operation fluid into the retarded angle chamber 42 while draining the operation fluid from the advanced angle chamber 43, the control valve 76 performs a retarded angle direction displacement operation for displacing the relative rotational phase between the outer rotor 2 and the inner rotor 1 in a retarded angle direction S1.

In a condition where the spool position is at position W2, the control valve 76 stops supply and discharge of the operation fluid relative to both of the advanced angle chamber 43 and the retarded angle chamber 42 (closes the first port 76*c* and the second port 76*d*), and performs a phase holding operation for holding the relative rotational phase between the outer rotor 2 and the inner rotor 1 at a given time at a given position.

In a condition where the spool position is at position W3, the control valve 76 supplies the operation fluid into the locking chamber 62, and makes the locking mechanism 6 into the unlock state. Further, by supplying the operation fluid into the advanced angle chamber 43 while draining the operation fluid from the retarded angle chamber 42, the control valve 76 performs an advanced angle direction displacement operation for displacing the relative rotational phase between the outer rotor 2 and the inner rotor 1 in an advanced angle direction S2.

In a condition where the spool position is at position W4, the control valve 76 drains the operation fluid from the locking chamber 62, and when the relative rotational phase becomes the lock phase, the control valve 76 makes the locking mechanism 6 into a lockable position. Further, the control valve 76 supplies the operation fluid into the advanced angle chamber 43 while draining the operation fluid from the retarded angle chamber 42. Thereby, when the relative rotational phase is at the lock phase, the control valve 76 performs an advanced angle biasing operation for biasing the relative rotational phase in the advanced angle direction S2 in a condition where the locking mechanism 6 is at the lock state. Until a warm-up of the engine is completed, the aforementioned operation is performed, by increasing a frictional force between the locking member 60 and a side wall surface of the locking chamber 62 of the locking mechanism 6, for preventing the locking mechanism 6 from being in the unlock state because of a retraction of the locking member 60 from the locking chamber 62 due to the centrifugal force.

In a condition where the spool position is at the position W5, a drain operation is performed for making a condition in which the operation fluid of the advanced angle chamber 43, the retarded angle chamber 42, and the locking chamber 62 can be discharged to the oil pan 75. Because of this operation, all of the first port 76*c*, the second port 76*d*, and the third port 76*e* of the control valve 76 communicate with the drain port 76*f*.

Figure 7:
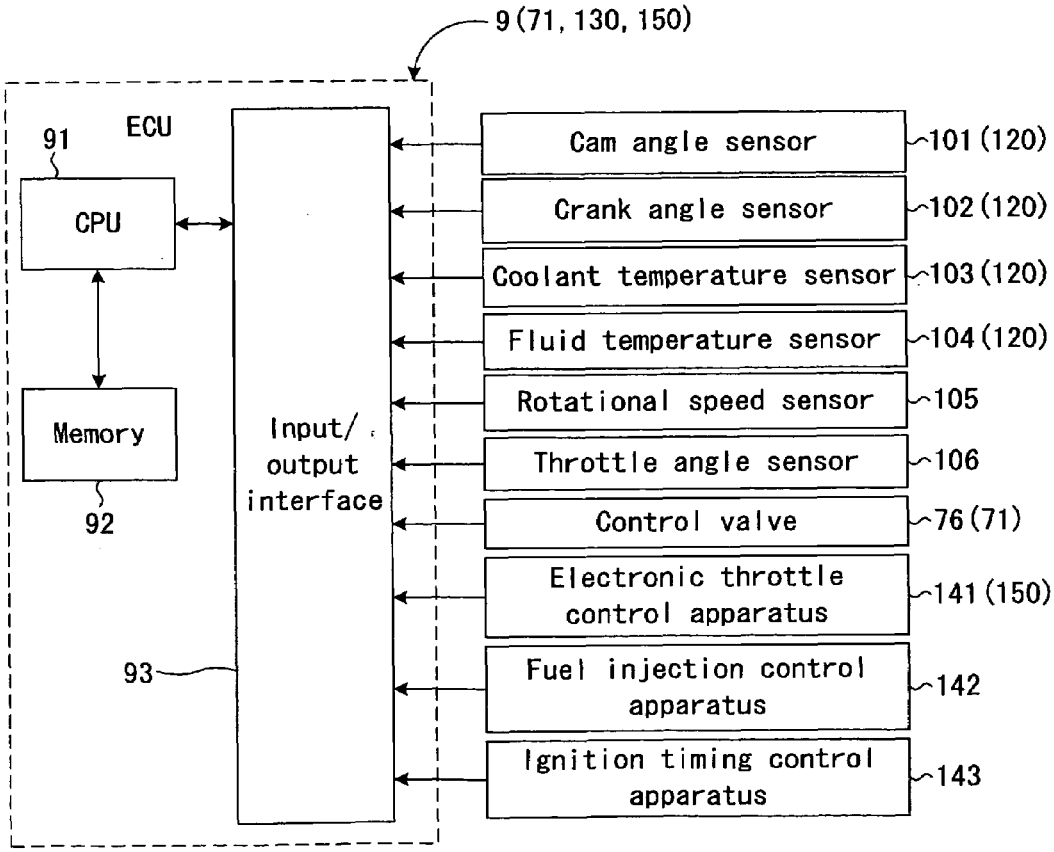
FIG. 7 is a block diagram illustrating an electrical connection structure of a control unit according to the embodiments of the present invention.

As illustrated in FIG. 7, the control unit 9 includes a central processing unit 91 (i.e., a CPU) for calculation, a memory 92 for storing predetermined programs, data tables, or the like, an input/output interface 93. The control unit 9 receives signals detected by various sensors such as a cam angle sensor 101 for detecting a camshaft phase, a crank angle sensor 102 for detecting a crankshaft phase, a coolant temperature sensor 103 for detecting a temperature of a cooling water of the engine (i.e., cooling fluid), a fluid temperature sensor 104 for detecting a temperature of the operation fluid, a rotational speed sensor 105 for detecting a rotational speed of the crankshaft (i.e., a rotational speed of the engine), a throttle angle sensor 106 for detecting an angle of a throttle, or the like. On the basis of the signals detected by the various sensors, the control unit 9 detects operating conditions of the engine. According to the embodiments of the present invention, one of, or both of the fluid temperature sensor 104 and the coolant temperature sensor 105 represents a fluid temperature detecting means 110.

The control unit 9 is connected to, besides the control valve 76, various control apparatuses for controlling each component of the engine such as an electronic throttle control apparatus 141 for controlling a throttle angle of the engine, a fuel injection control apparatus 142 for controlling a fuel injection, an ignition timing control apparatus 143 for controlling ignition timing, or the like.

On the basis of a phase of the camshaft 3 detected by the cam angle sensor 101 and a phase of the crankshaft detected by the crank angle sensor 102, the control unit 9 can obtain a relative rotational phase between the camshaft 3 and the crankshaft (i.e., the relative rotational phase between the inner rotor 1 and the outer rotor 2 of the valve timing control apparatus). Likewise, the displacement of the relative rotational phase between the inner rotor 1 and the outer rotor 2 can be obtained. Accordingly, both of the cam angle sensor 101 and the crank angle sensor 102 represent a relative rotational phase detecting means 120 according to the embodiments of the present invention.

On the basis of operating conditions of the engine such as a temperature of an engine fluid, a rotational speed of the crankshaft, a vehicle speed, a throttle angle, or the like, detected by the various sensors, the control unit 9 controls the amount of electricity supplied to the control valve 76. Thereby, the control unit 9 controls supply and discharge of the operation fluid relative to the advanced angle chamber 43, the retarded angle chamber 42, and the locking chamber 62, by means of the control valve 76. Accordingly the control unit 9 appropriately varies the relative rotational phase between the inner rotor 1 and the outer rotor 2, and conditions of the locking mechanism 6 so as to be suitable for the operating conditions of the engine of that time.

According to a first embodiment of the present invention, on the basis of results detected by the cam angle sensor 101 and the crank angle sensor 102 (i.e., the relative rotational phase detecting means 120), the control unit 9 judges a supply condition of the operation fluid relative to the fluid pressure chamber 40. Therefore, the control unit 9 represents a judging means 130 according to the embodiments of the present invention. Further, because the control unit 9 outputs a control order relative to, for example, the electronic throttle control apparatus 141, and controls the rotational speed of the engine (i.e., a rotational speed of the crankshaft), the control unit 9 also represents a control means 150 according to the embodiments of the present invention. Alternatively, or in addition, in order to restrain the rotational speed of the crankshaft, the control unit 9 may output a control order to the ignition timing control apparatus 143 for controlling ignition timing. Moreover, alternatively or in addition, the judging means 130 and the control means 150 may be an individual control unit. Operations of the control unit 9 are explained hereinafter.

Figure 8:
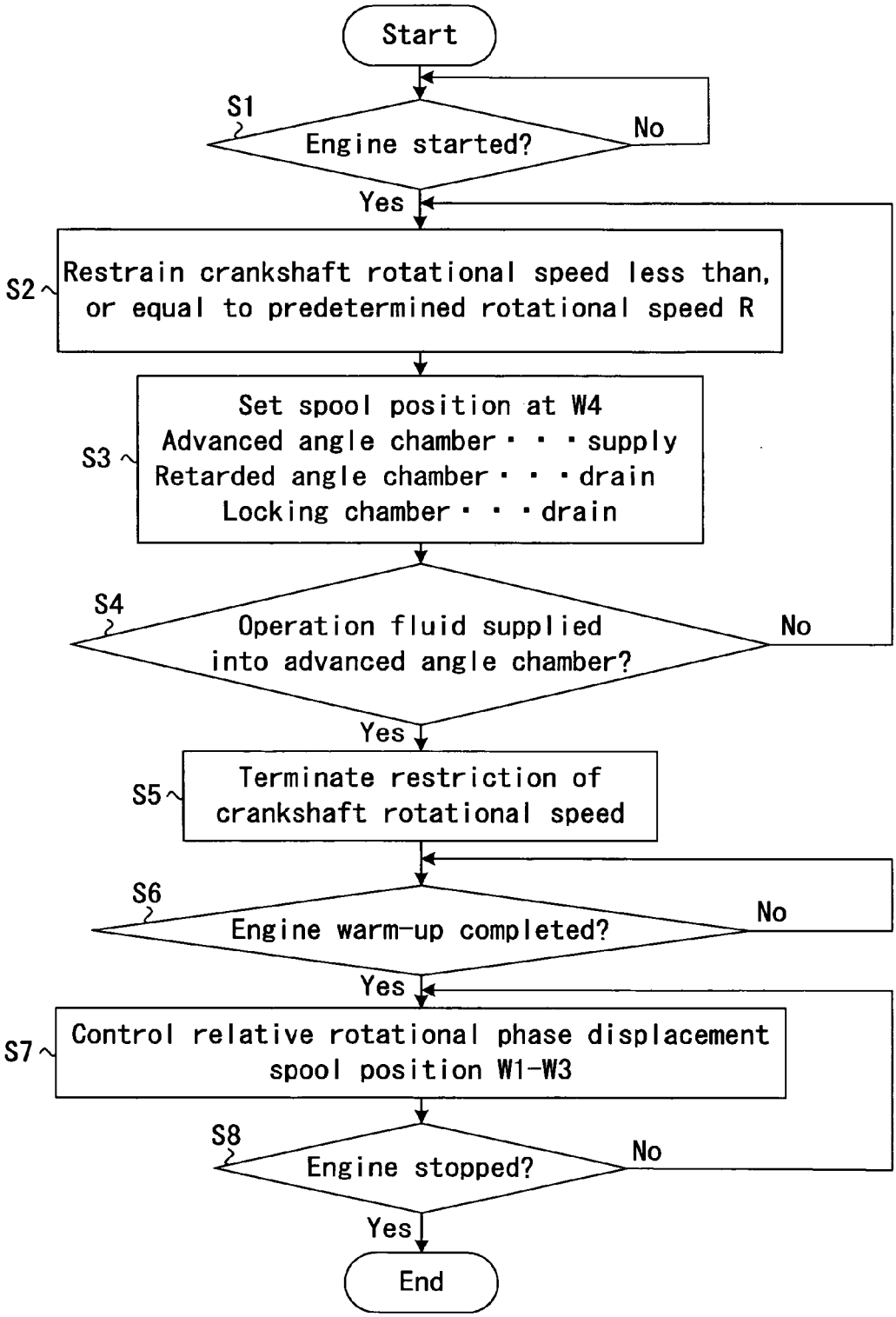
FIG. 8 is a flowchart illustrating an operation control of the valve timing control apparatus after an engine starting.

With reference to a flowchart illustrated in FIG. 8, operation control of the valve timing control apparatus according to the embodiments of the present invention is explained by focusing a control immediately after the engine starting. The operation control explained hereinafter is performed mainly by the CPU 91 according to various algorithms, or the like, stored in the memory 92.

When the engine is started (step S1: YES), the control unit 9 performs a control for restricting the rotational speed of the crankshaft (i.e., the rotational speed of the engine) less than, or equal to a predetermined rotational speed R (step S2). According to the embodiments of the present invention, on the basis of an output of the rotational speed sensor 105, the control unit 9 performs the aforementioned control by outputting a control order, relative to the electronic throttle control apparatus 141, for restricting the throttle angle so that the rotational speed of the crankshaft becomes less than, or equal to the predetermined rotational speed R. On this occasion, because of the cranking at the time of the engine starting, the locking mechanism 6 keeps its posture at the lock state.

In a condition where the locking mechanism 6 is at the lock state by protruding the locking member 60 into the locking chamber 62, the predetermined rotational speed R is set lower than a rotational speed with which the locking member 60 is operated outwardly in the radial direction of the outer rotor 2 and the inner rotor 1 because of the centrifugal force due to the rotation of the outer rotor 2 and the inner rotor 1 so that the locking mechanism 6 comes into the unlock state. On this occasion, it is assumed that the operation fluid is not supplied into the advanced angle chamber 43 or the retarded angle chamber 42. Specifically, the predetermined rotational speed R is set on the basis of, for example, a weight of the locking member 60, the biasing force of the spring 61 for biasing the locking member 60 inwardly in the radial direction, and a friction coefficient between the locking member 60 and the guide groove 64 provided at the outer rotor 2. A maximum value of the predetermined rotational speed R is a rotational speed, which is set in a condition where the centrifugal force, which is applied to the locking member 60 in response to a rotational speed of the inner rotor 1 and the outer rotor 2, and also in response to the weight of the locking member 60, in accordance with the biasing force of the spring 61, and a friction force of the guide groove 64. However, in practice, because of a manufacturing quality of the locking member 60 or the guide groove 64, or errors in loads of the spring 61, the maximum value of the predetermined rotational speed R varies with respect to each manufacture. Therefore, it is applicable as long as the predetermined rotational speed R is set to be, by means of a statistical process, a highest rotational speed with which the locking mechanism 6 does not come into the unlock state even in a consideration of the aforementioned errors. For example, the valve timing control apparatus is well operated by setting the predetermined rotational speed R around 2000 rpm in a condition where the weight of the locking member 60 is 4.9 g and the load of the spring 61 is 2.39N. Accordingly, the valve timing control apparatus can prevent the locking mechanism 6 from being in the unlock state because of the centrifugal force, without restraining the rotational speed of the crankshaft more than requires.

The control unit 9 performs the advanced angle biasing operation by varying the spool position of the control valve 76 to the position W4, and supplies the operation fluid into the advanced angle chamber 43 while draining the operation fluid from the retarded angle chamber 42 (step S3). At the position of W4, because the operation fluid of the locking chamber 62 is also drained, the locking mechanism 6 keeps its posture at the lock state. According to the advanced angle biasing operation of the control valve 76, in the lock state of the locking mechanism 6 where the locking member 60 protruding into the locking chamber 62 as illustrated in FIG. 2, because the operation fluid is supplied only into the advanced angle chamber 42, a biasing force is applied for displacing the relative rotational phase in the advanced angle direction. Thereby a side surface of the locking member 60 is pressed against the side wall surface of the locking chamber 62 so that a friction force therebetween is increased. Therefore, the locking member 60 is not easily retracted from the locking chamber 62. In consequence, in a condition where the advanced angle biasing operation is appropriately performed, an unintended unlock state of the locking mechanism 6 because of an increase of the rotational speed of the crankshaft can be prevented. Alternatively, or in addition, in order to obtain the aforementioned effects, the control valve 76 may perform a retarded angle biasing operation for supplying the operation fluid only into the retarded angle chamber 42 while draining the operation fluid from the advanced angle chamber 43 and the locking chamber 62.

However, immediately after the engine starting, because the operation fluid from the oil pump 70, which is activated by means of the engine, is not yet reached to the advanced angle chamber 43, the aforementioned advanced angle biasing operation cannot appropriately be performed. Accordingly, until the operation fluid is supplied form the oil pump 70 into the advanced angle 43, in order to prevent an increase of the rotational speed of the crankshaft, the control unit 9 performs a control, as described above, for restricting the rotational speed of the crankshaft less than, or equal to the predetermined rotational speed R (step S2). Thereby, the control unit 9 prevents the locking mechanism 6 from being in the unlock state because of an operation of the locking member 60 outwardly in the radial direction caused by the centrifugal force due to the rotation of the inner rotor 1 and the outer rotor 2.

Figure 9:
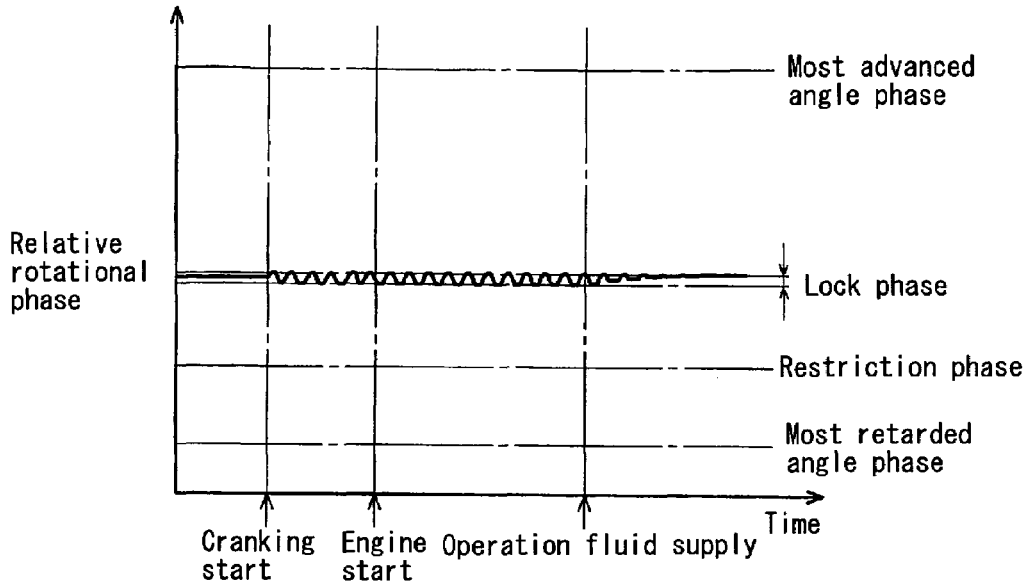
FIG. 9 is a timing chart illustrating variations of an oscillation of a displacement of the relative rotational phase of the valve timing control apparatus.

The control unit 9 judges whether or not the operation fluid is supplied into the advanced angle chamber 43 (step S4). According to the first embodiment of the present invention, this judgment is performed on the basis of the results detected by the cam angle sensor 101 and the crank angle sensor 102 (i.e., the relative rotational phase detecting means 120). During the engine in operation, by means of a torque fluctuation applied to the camshaft 3 at the time of the opening and closing of the valve, even at the lock state, the locking mechanism 6 can be oscillated by an amount of a space between the side surface of the locking member 60 and the side wall of the locking chamber 62. Therefore, the displacement of the relative rotational phase is detected as an oscillating waveform by means of the control unit 9. On this occasion, as illustrated in FIG. 9, an oscillation of the displacement of the relative rotational phase is larger degree in a condition where the operation fluid is not supplied in the advanced angle chamber 43. In contrast, when the operation fluid is supplied into the advanced angle chamber 43, because the biasing force is applied for displacing the relative rotational phase in the advanced angle direction by means of a pressure of the operation fluid, the side surface of the locking member 60 is pressed against the side wall surface of the locking chamber 62, and the oscillation of the displacement of the relative rotational phase is rapidly declined. Accordingly, on the basis of the results detected by the cam angle sensor 101 and the crank angle sensor 102, by detecting a decline of the oscillation of the displacement of the relative rotational phase, the control unit 9 can correctly judges whether or not the operation fluid is supplied into the advanced angle chamber 43. Therefore, the valve timing control apparatus can prevent the control unit 9 from restricting the rotational speed of the crankshaft for excessive amount of time. The torque fluctuation, which is applied to the cam shaft 3 during the cranking, is generated by means of, for example, a resistance of a valve spring in a condition where the cam provided at the camshaft 3 performs an opening and closing operation of the engine valve against the valve spring.

Figure 10:
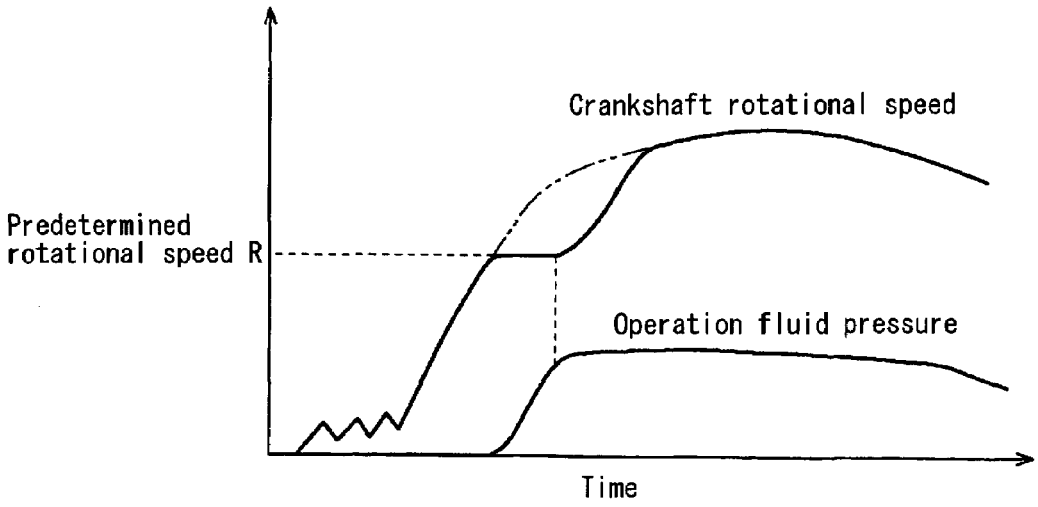
FIG. 10 is a timing chart illustrating a relation between a pressure of an operation fluid and a rotational speed of a crankshaft of the valve timing control apparatus.

In a condition where the control unit 9 judges that the operation fluid is not supplied into the advanced angle chamber 43 (step S4: NO), the procedure returns to step S2 and continue the control for restraining the rotational speed of the crankshaft less than, or equal to the predetermined rotational speed R. In contrast, when the control unit 9 judges that the operation fluid is supplied into the advanced angle chamber 43 (step S4: YES), the control unit 9 terminates the control for restraining the rotational speed of the crankshaft less than, or equal to the predetermined rotational speed R (step S5). Then, the control unit 9 outputs the control order relative to the electronic throttle control apparatus 141 for controlling the rotational speed of the engine according to a throttle operation by a driver. More particularly, according to the embodiments of the present invention, as illustrated in FIG. 10, until the pressure of the operation fluid in the advanced angle chamber 43 is increased, the control unit 9 performs the control for restricting the rotational speed of the crankshaft less than, or equal to the predetermined rotational speed R. In contrast, after the pressure of the operation fluid in the advanced chamber 43 is increased, the rotational speed of the engine is controlled to meet with the throttle operation of the driver.

In a condition where the warm-up of the engine is completed (step S6: YES), the control unit 9 terminates the advanced angle biasing operation of the control valve 76 (started in step S3), and begins a control under a normal driving condition for displacing the relative rotational phase according to engine operating conditions (step S7). More particularly, the control unit 9 performs a control for displacing the spool position of the control valve 76 within the position W1 to the position W3. The control under the normal driving condition (step S7) is performed until the engine is stopped, and when the engine is stopped (step S8: YES), the operation control of the valve timing control apparatus is terminated.

A second embodiment of the present invention is explained hereinafter. According to the first embodiment, on the basis of the results detected by the cam angle sensor 101 and the crank angle sensor 102 (i.e., the relative rotational phase detecting means 120), the judging means 130 (i.e., the control unit 9) judges whether or not the operation fluid is supplied into the fluid pressure chamber 40 (the advanced angle chamber 43). However, the invention is not limited thereto. Alternatively, or in addition, on the basis of results detected by one of, or both of the fluid temperature sensor 104 and the coolant temperature sensor 105 (i.e., the fluid temperature detecting means 110), the judging means 130 may judge whether or not the operation fluid is supplied into the fluid pressure chamber 40. More particularly, after a predetermined time is elapsed that is calculated by amending a predetermined standard design time T0, the judging means 130 judges that the operation fluid is supplied into the fluid pressure chamber 40. A judging operation of the judging means 130 on the basis of the results detected by the coolant temperature sensor 105 is explained hereinafter.

Figure 11:
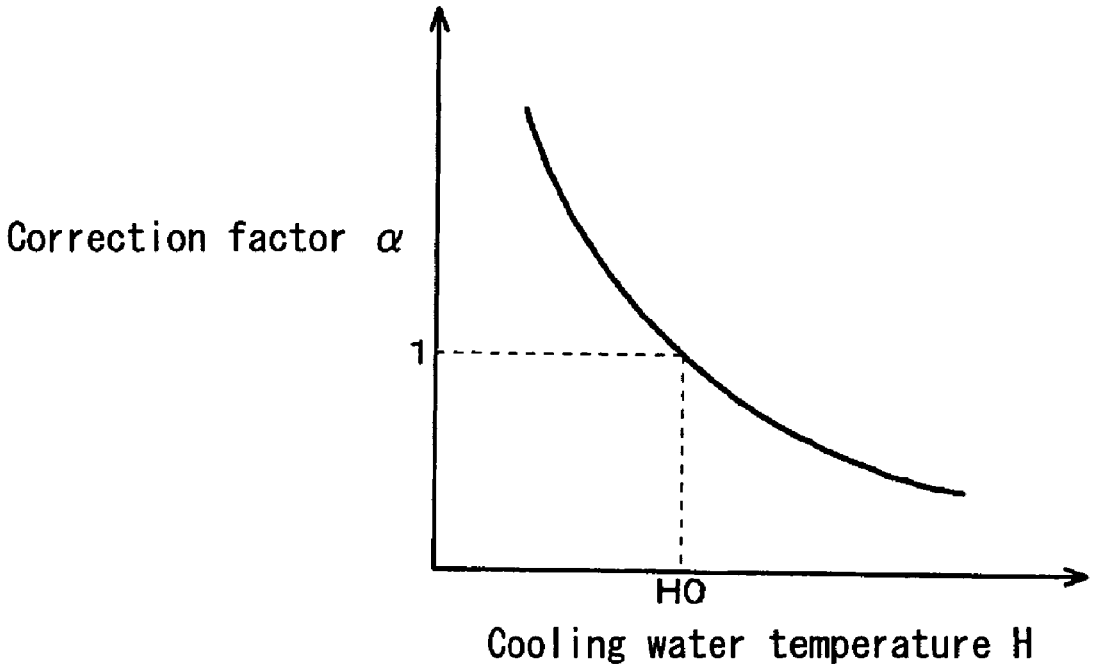
FIG. 11 is an example of a temperature-correction factor table applied to a valve timing control apparatus according to a second embodiment of the present invention.

In a condition where a viscosity of the operation fluid in the engine including the valve timing control apparatus, and a condition of the fluid pressure room 40 and fluid passages filled with the operation fluid are of certain standard conditions, the aforementioned predetermined standard design time T0 can be set as a time from the engine starting until a complete of a supplying operation of the operation fluid into the fluid pressure chamber 40 (an operation fluid supplying time T). Further, a most standard cooling water temperature H in a condition where the predetermined standard design time T0 is set to be the operation fluid supplying time T is assumed to be the standard temperature H0. On this occasion, a temperature difference between a temperature of outside air and a temperature of cooling water can be used as the cooling water temperature H. Further, an absolute temperature can be also used as the cooling water temperature H. The standard temperature H0 can be calculated by the statistical process on the basis of results obtained by a test using an actual engine. On the basis of the test, correlation between the cooling water temperature H and a variation rate of the fluid supplying time T, which varies, relative to the standard design time T0, in accordance with variations of the cooling water temperature H, is experimentally and statistically estimated. Then, as illustrated in FIG. 11, a temperature-correction factor table is created. On this occasion it is assumed that the variation rate of the fluid supplying time T is a correction factor $\alpha$. Further, a value of the correction factor $\alpha$ corresponding to the standard temperature H0 is 1. This temperature-correction factor table is stored in the memory 92 of the control unit 9.

On this occasion, when an elapsed time after an engine stop is lengthened, the cooling water temperature H of the engine is declined. The viscosity of the operation fluid relates to the temperature of the operation fluid, and the temperature of the operation fluid has a certain relation with the cooling water temperature H. Therefore, a certain correlation between the cooling water temperature H, the elapsed time after the engine stop, and the viscosity of the operation fluid can be estimated. Further, when the elapsed time after the engine stop is lengthened, the rate of the operation fluid flowing out from the fluid pressure chamber 40 and the fluid passages communicated thereto is increased, and thus the operation fluid supplying time T is lengthened. Moreover, when the viscosity of the operation fluid is increased, a resistance for transmitting the operation fluid into the fluid pressure chamber 40 is increased, and thus the operation fluid supplying time T is lengthened. Accordingly, a certain correlation can be estimated between the cooling water temperature H and the variation rate of the fluid supplying time T, which varies, relative to the standard design time T0, in accordance with the variations of the cooling water temperature H. Therefore, by use of the temperature-correction factor table, which defines the correlation between the cooling water temperature H and the variation rate of the fluid supplying time T, an estimated time of the operation fluid supplying time T can be estimated, with a certain reliability, on the basis of cooling water temperature H.

According to the second embodiment of the present invention, on the basis of the cooling water temperature H detected by coolant temperature sensor 105, and on the basis of the temperature-correction factor table, the control unit 9 estimates the estimated time of the operation fluid supplying time T. Then, the control unit 9 judges that the fluid pressure chamber 40 is supplied with the operation fluid when the estimated time of the operation fluid supplying time T is elapsed. Accordingly, the valve timing control apparatus can prevent the control unit 9 from restricting the rotational speed of the crankshaft for excessive amount of time. Although, the judgment of the judging means 130 on the basis of the results detected by the coolant temperature sensor 105 is explained, the judgment on the basis of the fluid temperature sensor 104 can be also performed in an identical manner.

According to the embodiments of the present invention, in a condition where a sufficient pressure of the operation fluid is not yet supplied relative to the fluid pressure chamber immediately after an internal combustion engine starting, the valve timing control apparatus can prevent an increase of the centrifugal force applied to the movable member of the locking mechanism because of a rotation of the driving side rotational member and the driven side rotational member. Therefore, the valve timing control apparatus can prevent the locking mechanism from being in the unlock state because of the centrifugal force. Accordingly a reliability of a restriction of the displacement of the relative rotational phase by means of the locking mechanism at the time of the internal combustion engine starting can be improved, and a startability of the internal combustion engine can be improved.

The principles, preferred embodiments and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve timing control apparatus for controlling an opening and closing timing of a valve of an internal combustion engine comprising:

a driving side rotational member synchronously rotated with a crankshaft;

a driven side rotational member provided coaxially with the driving side rotational member and synchronously rotated with a camshaft;

a fluid pressure chamber formed on at least one of the driving side rotational member and the driven side rotational member, the fluid pressure chamber being separated into an advanced angle chamber and a retarded angle chamber;

a phase control apparatus controlling supply and discharge of an operation fluid relative to one of, or both of the advanced angle chamber and the retarded angle chamber, for displacing a relative rotational phase between the driving side rotational member and the driven side rotational member;

a locking mechanism having a movable member movable in a radial direction of the driving side rotational member and the driven side rotational member, the locking mechanism being at a lock state for restraining a displacement of the relative rotational phase when the movable member moves inwardly in the radial direction, and the locking mechanism being at an unlock state for allowing the displacement of the relative rotational phase when the movable member moves outwardly in the radial direction;

a judging means for judging a supply condition of the operation fluid relative to the fluid pressure chamber; and a control means for controlling, after the internal combustion engine is started, a rotational speed of the crankshaft less than or equal to a predetermined rotational speed, until the judging means judges that the operation fluid is supplied into the fluid pressure chamber.

2. The valve timing control apparatus according to claim 1, wherein the predetermined rotational speed is set lower than a rotational speed with which the locking mechanism comes into the unlock state because of a movement of the movable member outwardly in the radial direction caused by a centrifugal force because of a rotation of the driving side rotational member and the driven side rotational member.

3. The valve timing control apparatus according to claim 1, wherein the judging means includes:

a relative rotational phase detecting means for detecting the displacement of the relative rotational phase, wherein on the basis of a decline of an oscillation of the relative rotational phase detected by the relative rotational phase detecting means, the judging means judges whether the operation fluid is supplied into the fluid pressure chamber.

4. The valve timing control apparatus according to claim 1, wherein the judging means includes:

a fluid temperature detecting means for detecting at least one of a temperature of a cooling fluid of the internal combustion engine and a temperature of the operation fluid, wherein when a predetermined time is elapsed that is calculated by amending a predetermined standard design time on the basis of results detected by the fluid temperature detecting means, the judging means judges that the operation fluid is supplied into the fluid pressure chamber.

5. The valve timing control apparatus according to claim 3, wherein the relative rotational phase detecting means includes:

a first rotational phase detecting means for detecting a rotational phase of the crankshaft, and a second rotational phase detecting means for detecting a rotational phase of the camshaft.

6. The valve timing control apparatus according to claim 1, wherein the control means maintains the rotational speed of the crankshaft at the predetermined rotational speed.

* * * * *